US007226093B1

(12) United States Patent
Stailey

(10) Patent No.: US 7,226,093 B1
(45) Date of Patent: Jun. 5, 2007

(54) APPARATUS AND METHOD TO REINFORCE DOORS AGAINST WINDSTORM

(76) Inventor: Ronald L. Stailey, 613 Yorkshire Dr., Flagler Beach, FL (US) 32136

( * ) Notice: Subject to any disclaimer, the term of this patent is extended or adjusted under 35 U.S.C. 154(b) by 90 days.

(21) Appl. No.: 11/166,841

(22) Filed: Jun. 27, 2005

(51) Int. Cl.
*E05C 19/00* (2006.01)

(52) U.S. Cl. ..... 292/259 R; 292/DIG. 17

(58) Field of Classification Search ..... 292/259 R, 292/DIG. 17
See application file for complete search history.

(56) References Cited

U.S. PATENT DOCUMENTS

| | | | | |
|---|---|---|---|---|
| 698,326 | A * | 4/1902 | Schwab | 70/134 |
| 4,228,841 | A | 10/1980 | Dixon | |
| 4,922,987 | A | 5/1990 | Marontate et al. | |
| 4,944,169 | A | 7/1990 | LaBelle et al. | |
| 5,257,581 | A * | 11/1993 | Welling | 109/24 |
| 5,340,172 | A * | 8/1994 | Sweet | 292/259 R |
| 5,732,986 | A * | 3/1998 | Piva | 292/5 |
| 6,644,698 | B1 | 11/2003 | Chrestensen | |
| 2003/0201649 | A1 | 10/2003 | Christensen | |

* cited by examiner

*Primary Examiner*—Gary Estremsky
(74) *Attorney, Agent, or Firm*—Paul S. Rooy

(57) ABSTRACT

An apparatus and method to reinforce doors against windstorm. The apparatus includes a bar, and at least one bar bracket with a bar aperture sized to admit the bar, at least one pair of opposed ears, and an ear aperture in each ear. At least one bar bracket is mounted to an existing door hinge using a bracket fastener through a pair of ear apertures and a hinge bore in the hinge. Shims may be installed between the bar and the door and/or wall. The method includes the steps of removing a hinge pin from an existing hinge, positioning a bar bracket on the hinge such that the hinge is disposed between a pair of ears, inserting a bracket fastener through the ear bores and the hinge bore, and inserting a bar through at least one bar aperture. The bar may then be shimmed in place.

25 Claims, 8 Drawing Sheets

APPARATUS AND METHOD TO REINFORCE DOORS AGAINST WINDSTORM

BACKGROUND OF THE INVENTION

1. Field of the Invention

This invention relates to door reinforcements, and in particular to an apparatus and method to reinforce doors against windstorm.

2. Background of the Invention

Windstorms cause huge amounts of damage to buildings every year. These windstorms may be hurricanes, tornadoes, typhoons, or other meteorological phenomena which give rise to winds sufficiently high so as to endanger structures.

An important strategy in the fight against windstorm damage is to prevent breach of the building itself. Breaches may occur through windows or doors, or other vulnerable building feature, and allow wind to enter the structure. If wind forces its way into a structure, it can cause high enough internal building pressure so as to literally blow the roof off the building. Another possibility is that the high pressure inside a building caused by a building breach can blow out windows or building doors.

The loss of part or all of a roof, doors, and/or windows creates a path for the entry of rain, which may be driven virtually horizontally due to the high winds associated with windstorms. This rain can cause extensive water damage in the interior of a structure, and is an undesirable side effect of the initial breach. Thus, while an initial breach through a door or window may be relatively minor, it can be the first link in a chain of events which culminates in catastrophic damage to the structure itself, including but riot limited to extensive water damage, loss of roof, and eventually, even building collapse.

Therefore, it would be desirable to provide an apparatus and method to reinforce doors against windstorm, whereby an initial breach through the door, along with attendant undesirable side effects, may be avoided.

SUMMARY OF THE INVENTION

Accordingly, it is an object of the present invention to provide an apparatus and method to reinforce doors against windstorm which mounts to existing door hardware. Design features allowing this object to be accomplished include a bar bracket with ears spaced to admit an existing hinge, each ear having an ear bore sized to admit a bracket fastener sized to fit through the existing hinge. Advantages associated with the accomplishment of this object include ease of installation and avoidance of the necessity of making additional, unsightly holes in the door.

It is another object of the present invention to provide an apparatus and method to reinforce doors against windstorm which installs quickly and easily to existing door installations. Design features allowing this object to be accomplished include a bar bracket with ears spaced to admit an existing hinge, each ear having an ear bore sized to admit a bracket fastener sized to fit through the existing hinge, and a bar sized to fit into a bar aperture in the bar bracket. Benefits associated with the accomplishment of this object include saved time and cost in installation of the apparatus to reinforce doors against windstorm.

It is another object of the present invention to provide an apparatus and method to reinforce doors against windstorm which is simple to install. Method steps include removing a hinge pin from an existing hinge, positioning a bar bracket on the hinge such that the hinge is disposed between a pair of ears, inserting a bar bracket fastener through the ear bores and the hinge bore, inserting a bar through at least one bar aperture, and shimming the bar in place. Benefits associated with the accomplishment of this object include saved time and cost in installation of the apparatus to reinforce doors against windstorm.

It is yet another object of this invention to provide an apparatus and method to reinforce doors against windstorm which is simple and inexpensive. Design features allowing this object to be achieved include the use of components made of readily available materials, and the use of off-the-shelf components. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Eight sheets of drawings are provided. Sheet one contains FIG. 1. Sheet two contains FIGS. 2 and 3. Sheet three contains FIGS. 4 and 5. Sheet four contains FIG. 6. Sheet five contains FIG. 7. Sheet six contains FIG. 8. Sheet seven contains FIGS. 9 and 10. Sheet eight contains FIGS. 11 and 12.

DETAILED DESCRIPTION OF THE PREFERRED EMBODIMENT

Figure 1:
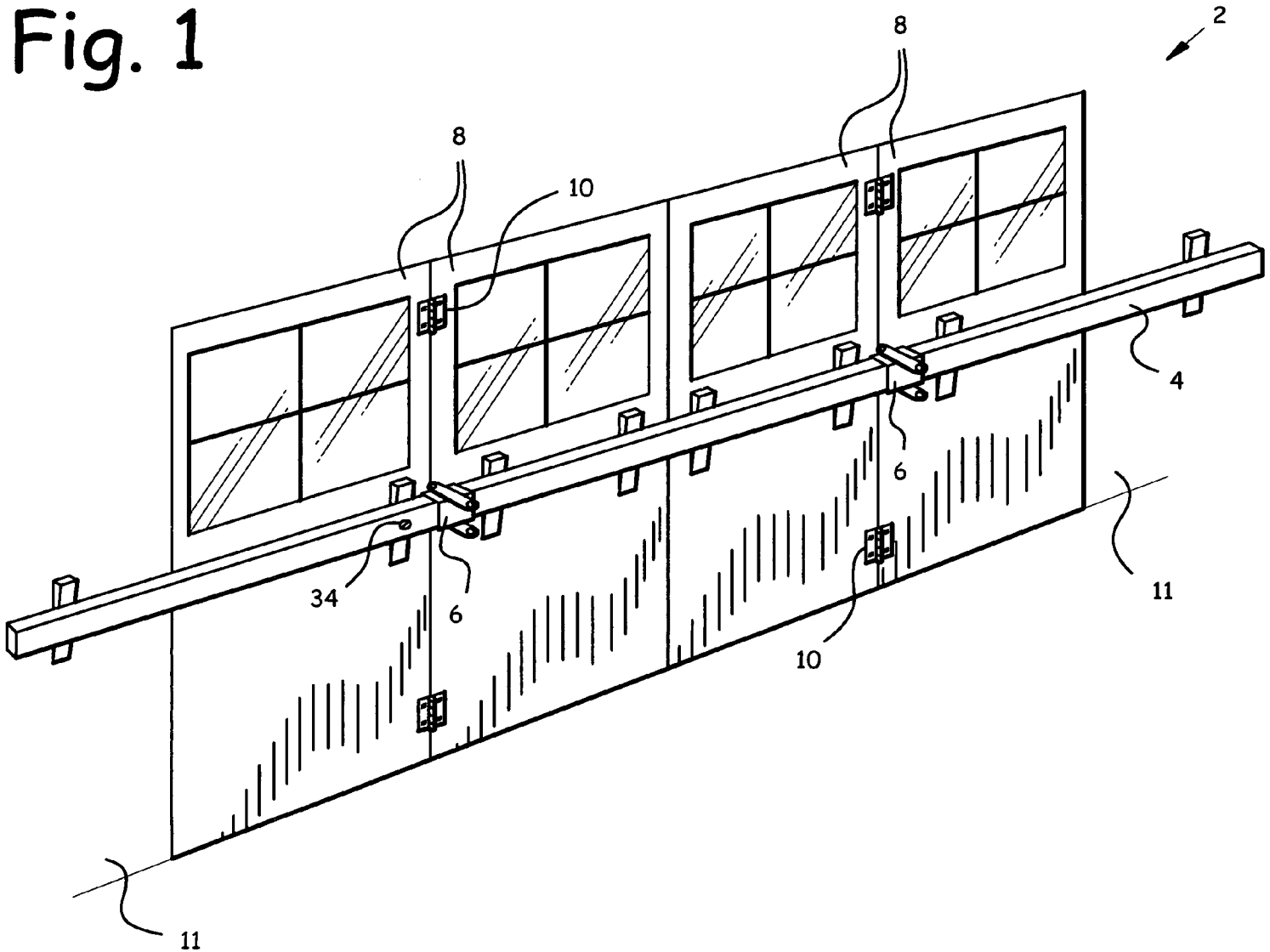
FIG. 1 is a front isometric view of an apparatus to reinforce doors against windstorm installed on a pair of double doors.

FIG. 1 is a front isometric view of an apparatus to reinforce doors against windstorm 2 installed on a pair of double doors. In the embodiment depicted in FIG. 1, apparatus to reinforce doors against windstorm 2 comprises at least one bar bracket 6 removably attached to existing hinge 10, means to removably attach each bar bracket 6 to an existing hinge 10, bar 4 disposed within a bar aperture 18 in each bar bracket 6, and shims 12 disposed between bar 4 and wall 11 and/or doors 8. Shims 12 may be optionally attached to bar 4 by means of shim fastener 34. In the preferred embodiment, shim fastener 34 was a screw driven through bar 4 into shim 12(*s*).

Figure 2:
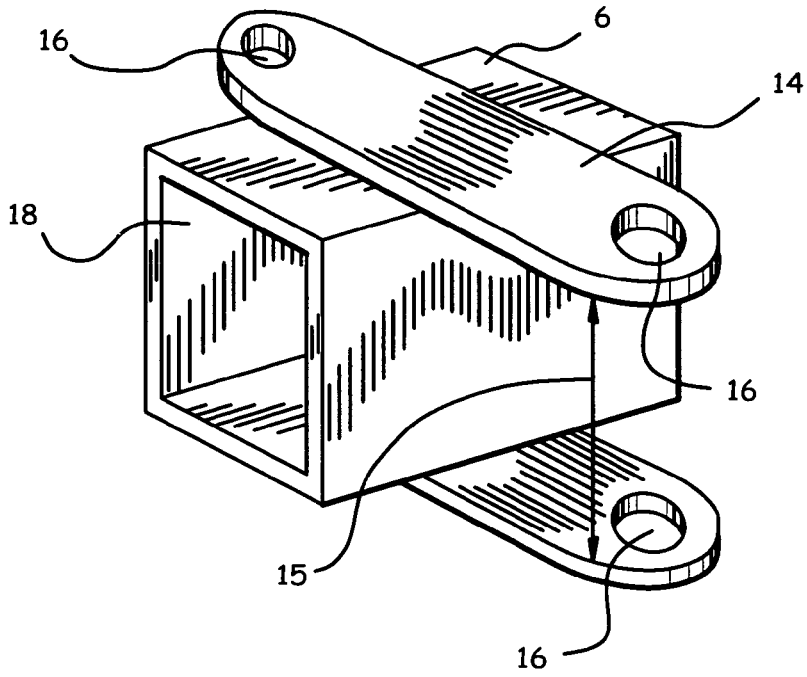
FIG. 2 is a front quarter isometric view of a bar bracket.
Figure 3:
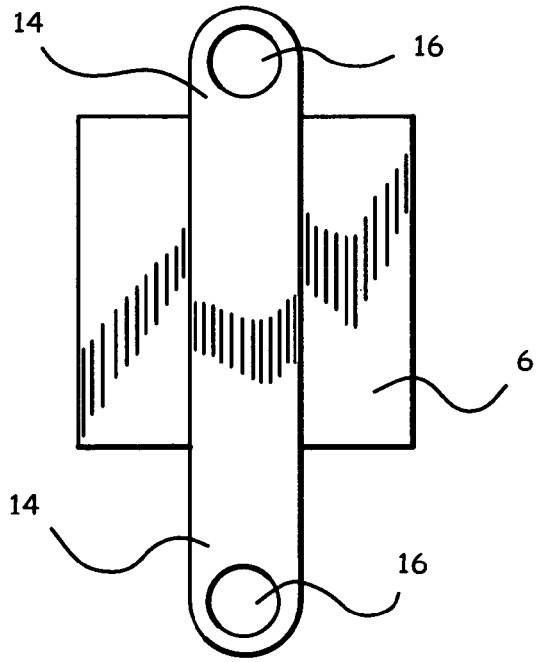
FIG. 3 is a top view of a bar bracket.
Figure 4:
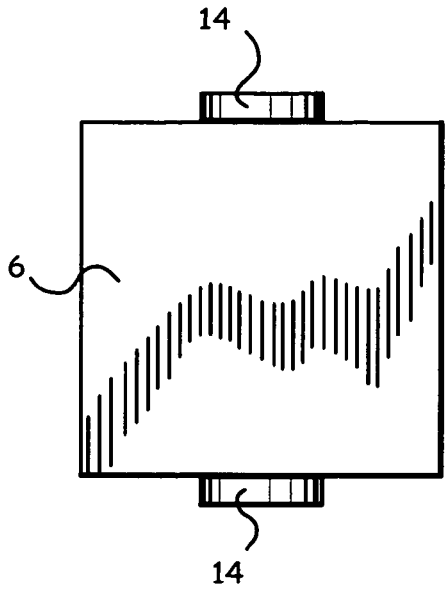
FIG. 4 is a front view of a bar bracket.
Figure 5:
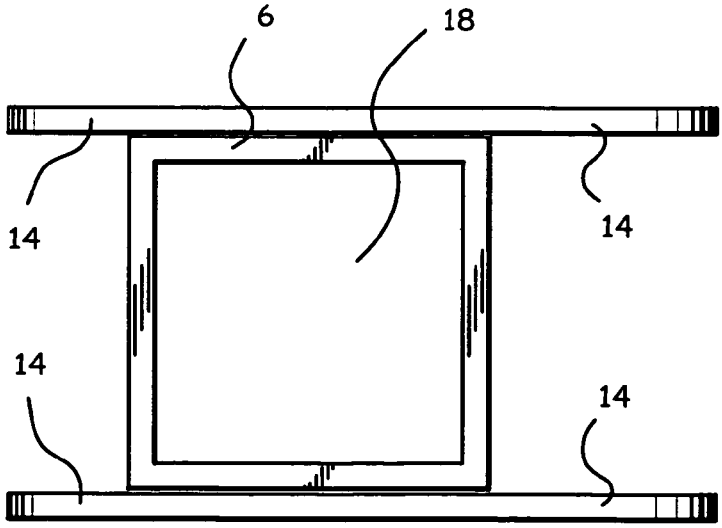
FIG. 5 is a side view of a bar bracket.

FIG. 2 is a front quarter isometric view of bar bracket 6. FIG. 3 is a top view of bar bracket 6. FIG. 4 is a front view of bar bracket 6. FIG. 5 is a side view of bar bracket 6. Bar bracket 6 comprises bar aperture 18 sized to admit bar 4, and at least one pair of opposed ears 14 mutually separated by an ear distance 15. Ear distance 15 is sized to admit existing hinge 10. In the preferred embodiment, existing hinge 10 was a standard door hinge. Thus, in the preferred embodiment, ear distance 15 was sized to admit a standard door hinge.

Figure 6:
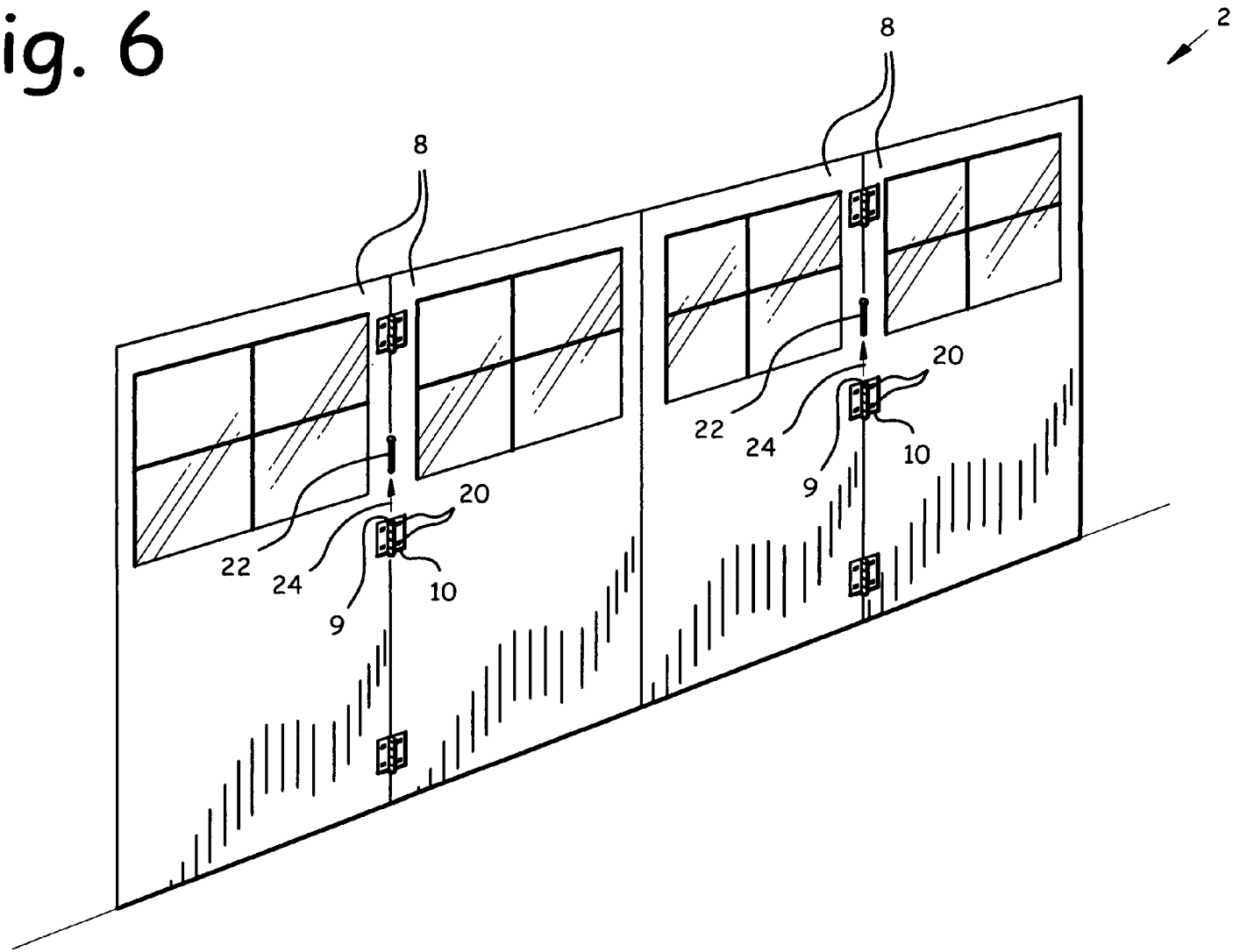
FIGS. 6 through 8 are front isometric views of an apparatus to reinforce doors against windstorm being installed on a pair of double doors.

During installation, existing hinge pin 22 is removed from an existing hinge 10 upon which a bar bracket 6 is to be installed, as may be observed in FIG. 6. An ear bore 16 is disposed in each ear 14 at an extreme of each ear 14 opposite bar aperture 18. Ear bores 16 are sized to admit a bracket fastener 26, as may be observed in FIG. 7. Each bracket fastener 16 is sized to fit into an existing hinge bore 9 where hinge pin 22 initially reposed. In the preferred embodiment, bracket fastener 16 was a bolt sized to fit into hinge bore 9, and sufficiently long to permit one end to extend beyond bar bracket 6 and a nut to be tightened onto the protruding bolt end.

As may be noted in FIGS. 2 and 6, in the preferred embodiment bar bracket 6 incorporated two pairs of opposed ears 14, one pair extending further than the other. Thus, where door trim or molding may preclude use of the shorter pair of opposed ears 14, the longer pair of opposed ears 14 may be used to secure bar bracket 6 to hinge 10.

Figure 7:
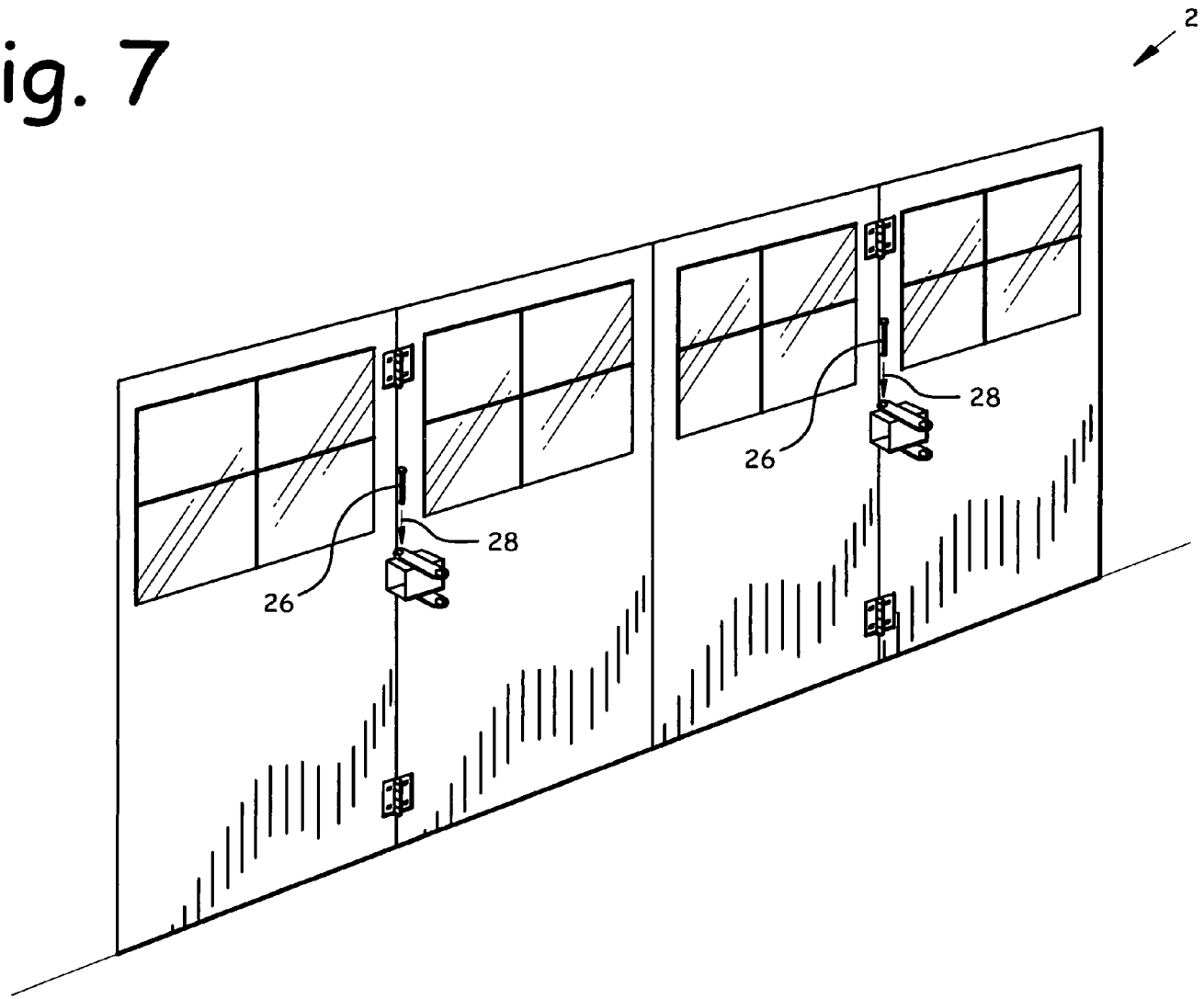
Figure 8:
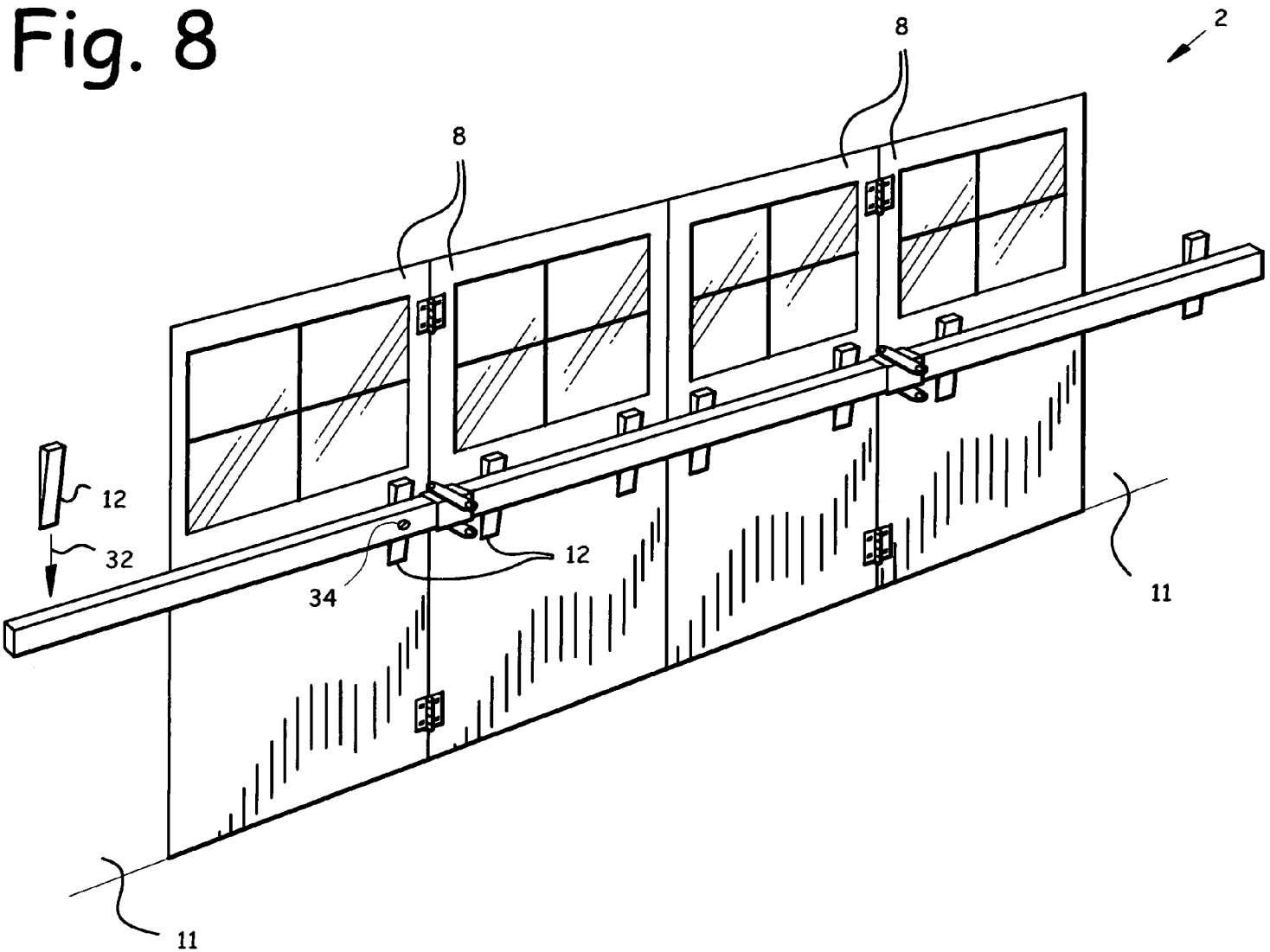

FIGS. 6 through 8 are front isometric views of an apparatus to reinforce doors against windstorm 2 being installed on a pair of double doors. First, existing hinge fasteners 20 (typically screws) may be optionally replaced with larger and/or more robust hinge fasteners in order to strengthen the attachment of hinge 10 to doors 8. Then, as indicated by arrows 24 in FIG. 6, hinge pin 22 is removed from hinge 10 to which bar bracket 6 is to be attached.

Next, as illustrated in FIG. 7, bar bracket 6 is positioned on hinge 10 such that hinge 10 is disposed between a pair of opposed ears 14, and ear bores 16 are co-axial with hinge bore 9. Bracket fastener 26 is then inserted through opposed ear bores 16 and hinge bore 9 as indicated by arrows 28, and a nut optionally fastened on the protruding end of bracket fastener 26.

The above steps are repeated to install all bar brackets 6 which are desired to be installed on the existing double doors. Then bar 4 is inserted through bar apertures 18 in bar brackets 6, as depicted in FIG. 8. Shims 12 may then be driven between bar 4 and wall 11 and/or doors 8, as indicated by arrow 32. Shim fasteners 34 may optionally be used to secure shims 12 in place on bar 4. In the preferred embodiment, shim fastener 34 was a screw driven through bar 4 into shim(s) 12. Finally, FIG. 1 depicts door reinforcement apparatus completely installed on existing doors 8.

Thus, the instant method to reinforce doors against windstorm comprises the steps of:

A. Providing at least one bar bracket 6 having a bar aperture 18 and at least one pair of opposed ears 14, and an ear bore 16 in each said ear 14;

B. Removing a hinge pin 22 from a hinge bore 9 in an existing hinge 10 on a door 8, upon which said bar bracket 6 is to be installed;

C. Positioning said bar bracket 6 on said hinge 10 such that said hinge 10 is disposed between said opposed ears 14, and said ear bores 16 and said hinge bore 9 are co-axial;

D. Inserting a bracket fastener 26 through said ear bores 16 and said hinge bore 9;

E. Optionally installing a nut on a protruding end of said bracket fastener 26;

F. Repeating steps A-E until all desired bar brackets 6 are installed;

G. Inserting a bar 4 through at least one said bar aperture 18;

H. Driving at least one shim 12 between said bar 4 and at least one said door 8 and/or an adjacent wall 11; and I. Optionally fastening at least one said shim 12 to said bar 4 with a shim fastener 34.

Figure 9:
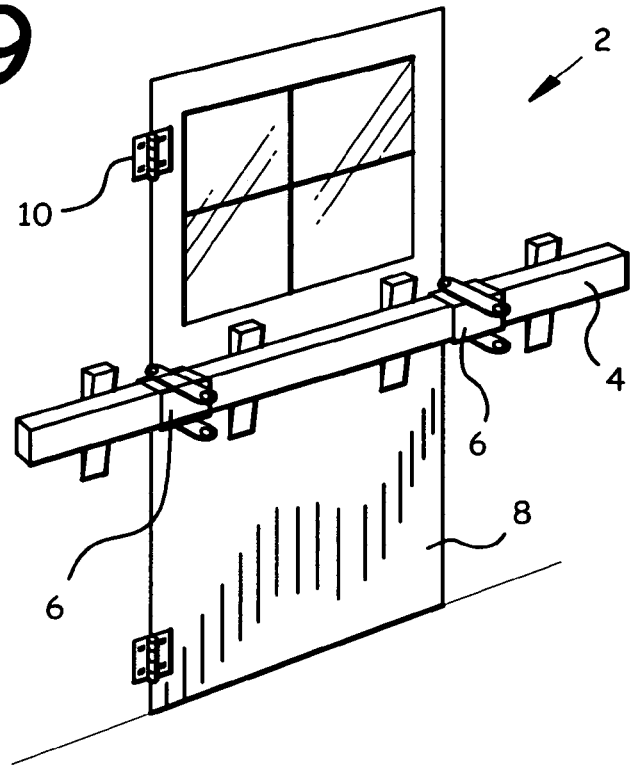
FIG. 9 is a front isometric view of an apparatus to reinforce doors against windstorm installed on a single door.

FIG. 9 is a front isometric view of an alternate embodiment apparatus to reinforce doors against windstorm 2 installed on a single door 10. As described above, hinge pin 22 is removed from at least one hinge 10 upon which a bar bracket 6 is to be installed as indicated by arrow 24, bar bracket 6 is installed on the hinge 10 by means of bracket fastener 26 as indicated by arrow 28, bar 4 is inserted through at least one bar aperture 18, and shimmed in place with shims 12 as indicated by arrow 32. Note a single bar bracket 6 could be used for the purpose.

Figure 10:
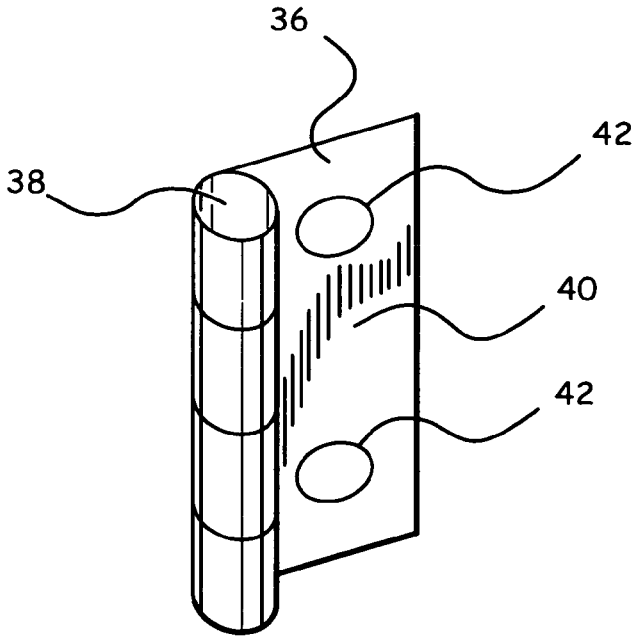
FIG. 10 is a front isometric view of a hinge leaf.
Figure 11:
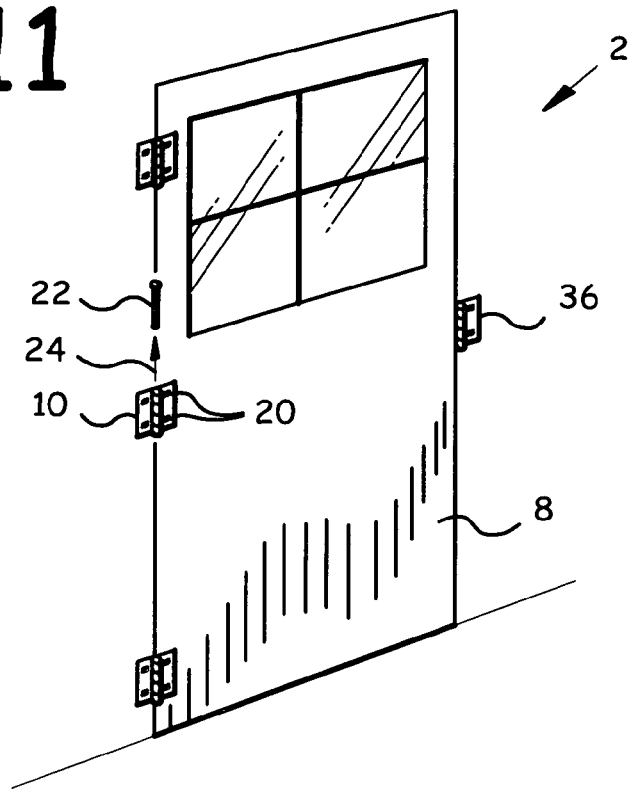
FIGS. 11 and 12 are front isometric views of an apparatus to reinforce doors against windstorm being installed on a single door.
Figure 12:
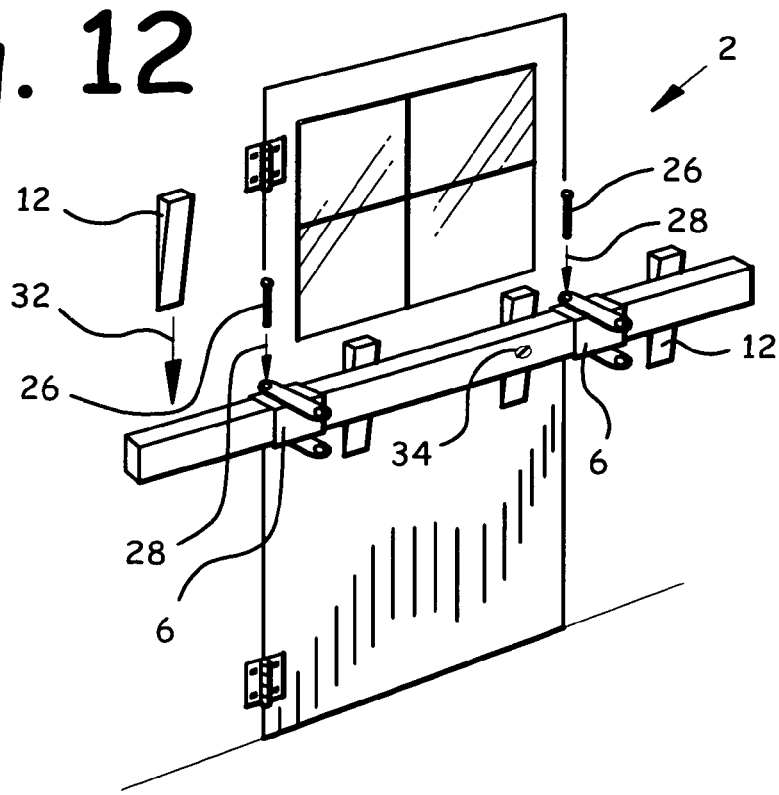

FIGS. 10-12 depict an alternate embodiment installation of apparatus to reinforce doors against windstorm 2 installed on a single door 8 comprising two bar brackets 10, one installed on hinge leaf 36.

FIG. 10 is a front isometric view of hinge leaf 36. Hinge leaf 36 comprises hinge leaf wing 40 and hinge leaf bore 38. Hinge leaf wing 40 comprises at least one hinge leaf wing bore 42.

FIGS. 11 and 12 are front isometric views of an apparatus to reinforce doors against windstorm 2 being installed on a single door 8 using optional hinge leaf 36. A bar bracket 6 is installed on an existing hinge 10 as described above and as depicted in FIGS. 11 and 12. Hinge leaf 36 is installed on the door frame opposite the existing hinge 10 upon which a bar bracket 6 has been installed, as illustrated in FIG. 11. Hinge leaf 36 may be installed on the door frame by means of fasteners through hinge leaf wing bores 42. In the preferred embodiment, hinge leaf 36 was half of a conventional hinge.

A bar bracket 6 is then installed on hinge leaf 36 by positioning the bar bracket 6 on hinge leaf 36 such that the hinge leaf 36 is disposed between opposed ears 14 on the bar bracket 6, and the ear bores 16 and the hinge leaf bore 38 are co-axial. Then a bar bracket fastener 26 is inserted through the ear bores 16 and the hinge leaf bore 38, and a nut is optionally installed on a protruding end of the bar bracket fastener 26.

Then bar 4 is inserted through the bar apertures 18 and shimmed in place using shims 12, and optionally shim fasteners 34.

Thus, the instant method to reinforce a single door against windstorm comprises the steps of:

A. Providing an apparatus to reinforce doors against windstorm comprising at least one bar bracket 6 having a bar aperture 18 and at least one pair of opposed ears 14, and an ear bore 16 in each said ear 14;

B. Removing a hinge pin 22 from a hinge bore 9 in an existing hinge 10 on a door 8, upon which said bar bracket 6 is to be installed;

C. Positioning said bar bracket 6 on said hinge 10 such that said hinge 10 is disposed between said opposed ears 14, and said ear bores 16 and said hinge bore 9 are co-axial;

D. Inserting a bar bracket fastener 26 through said ear bores 16 and said hinge bore 9;

E. Optionally installing a nut on a protruding end of said bar bracket fastener 26;

F. Inserting a bar 4 through said bar aperture 18;

G. Driving at least one shim 12 between said bar 4 and at least one said door 8 and/or an adjacent wall 11; and H. Optionally fastening at least one said shim 12 to said bar 4 with a shim fastener 34.

The instant method to reinforce a single door against windstorm may comprises the further steps of:

I. Providing a hinge leaf 36 having a hinge leaf wing 40 and a hinge leaf bore 38;

J. Attaching said hinge leaf 36 to a door frame opposite the bar bracket 6 installed on said hinge 10;

K. Positioning a bar bracket 6 on said hinge leaf 36 such that said hinge leaf 36 is disposed between said opposed ears 14, and said ear bores 16 and said hinge leaf bore 38 are co-axial;

L. Inserting a bar bracket fastener 26 through said ear bores 16 and said hinge leaf bore 38;

M. Optionally installing a nut on a protruding end of said bar bracket fastener 26; and N. Inserting said bar 4 through said bar aperture 18 in said bar bracket 6 installed on said hinge leaf 36.

As described above in relation to all method embodiments to install apparatus to reinforce doors against windstorm 2, bar 4 is inserted through bar aperture(s) 18 after bar bracket (s) 6 are installed on existing hinge(s) 10 and/or hinge leaf 36. If the physical space available prohibits this procedure, then bar bracket(s) 6 may be slid onto bar 4 prior to installing bar bracket(s) 6 on existing hinge(s) 10 and/or hinge leaf 36.

Apparatus to reinforce doors against windstorm 2 is removed by simply reversing the above steps, including re-installation of hinge pin(s) 22.

In the preferred embodiment, bar bracket 6 was made of metal, synthetic, or other appropriate material. Bracket fastener 26 and shim fastener 34 were off-the-self fasteners such as screws. Shims 12 were conventional prism-shaped shims. Hinge leaf 36 was half of a standard, off-the-shelf hinge.

While a preferred embodiment of the invention has been illustrated herein, it is to be understood that changes and variations may be made by those skilled in the art without departing from the spirit of the appending claims.

DRAWING ITEM INDEX

2 apparatus to reinforce doors against windstorm
4 bar
6 bar bracket
8 door
9 hinge bore
10 hinge
11 wall
12 shim
14 ear
15 ear distance
16 ear bore
18 bar aperture
20 hinge fastener
22 hinge pin
24 arrow
26 bracket fastener
28 arrow
32 arrow
34 shim fastener
36 hinge leaf
38 hinge leaf bore
40 hinge leaf wing
42 hinge leaf wing bore

I claim:

1. An apparatus reinforcing doors against windstorm comprising a bar, at least one bar bracket having a bar aperture sized to slidably admit said bar, at least one pair of opposed ears extending away from said bar aperture, an ear bore in each said ear at an extreme of said ear opposite said bar aperture, a door hinge from which said door hingeadly depends received between said ears, a length of said bar exceeding a width of said door reinforced by said apparatus.

2. The apparatus to reinforce doors against windstorm of claim 1 wherein said apparatus to reinforce doors against windstorm further comprises a bracket fastener sized to fit through said ear bores and a hinge bore in said hinge, said bracket fastener being disposed within said ear bores and said hinge bore.

3. The apparatus to reinforce doors against windstorm of claim 2 further comprising at least one shim sized to frictionally fit between said bar and a door or wall adjacent said bar when said bar is disposed within said at least one bar aperture and said bar bracket is fastened to a door hinge by means of said bracket fastener.

4. The apparatus to reinforce doors against windstorm of claim 2 wherein said bar bracket comprises two pairs of opposed ears extending away from said bar aperture, one said pair of opposed ears extending a greater distance away from said bar aperture than the other said pair of opposed ears, whereby said bar bracket may be attached to a variety of different door hinges having different clearances.

5. The apparatus to reinforce doors against windstorm of claim 3 further comprising at least one shim fastener whereby at least one said shim may be attached to said bar.

6. The apparatus to reinforce doors against windstorm of claim 1 further comprising a hinge leaf, said hinge leaf comprising a hinge leaf bore and a hinge leaf wing, and means of attaching said hinge leaf to a door frame opposite an existing hinge, whereby a single door may be reinforced against windstorm.

7. The apparatus to reinforce doors against windstorm of claim 6 comprising two said bar brackets, each said pair of opposed ears being mutually spaced apart by an ear distance, said ear distance being sufficient to admit a door hinge or said hinge leaf, and wherein said apparatus to reinforce doors against windstorm further comprises a bracket fastener for each said bar bracket, each said bracket being sized to fit through one pair of said ear bores and a hinge bore in said hinge, or through one pair of said ear bores and said hinge leaf bore.

8. The apparatus to reinforce doors against windstorm of claim 7 further comprising at least one shim sized to frictionally fit between said bar and a door or wall adjacent said bar when said bar is disposed within the bar apertures, one said bar bracket is fastened to said door hinge by means of one said bracket fastener, and the other bar bracket is fastened to said hinge leaf by means of the other said bracket fastener.

9. The apparatus to reinforce doors against windstorm of claim 8 wherein said means of attaching said hinge loaf to a door frame comprises at least one hinge leaf wing bore in said hinge leaf wing, and a fastener through each said hinge leaf wing bore into said door frame.

10. An apparatus reinforcing doors against windstorm comprising a bar, two bar brackets, each said bar bracket comprising a bar aperture sized to slidably admit said bar and at least one pair of opposed ears extending away from said bar aperture, an ear bore in each said ear at an extreme of said ear opposite said bar aperture, a door hinge from which said door hingeadly depends received between said ears, a length of said bar exceeding a width of said door reinforced by said apparatus.

11. The apparatus to reinforce doors against windstorm of claim 10 wherein said doors comprise two door hinges, and wherein said apparatus to reinforce doors against windstorm further comprises a bracket fastener associated with each said bar bracket, said bracket fastener being sited to fit through one pair said ear bores and a hinge bore in one said hinge, said bracket fastener being disposed within said ear bores and said hinge bore.

12. The apparatus to reinforce doors against windstorm of claim 11 further comprising at least one shim sized to frictionally fit between said bar and one said door or a wall adjacent said bar when said bar is disposed within the bar apertures and said bar brackets are fastened to said door hinges by means of said bracket fasteners.

13. The apparatus to reinforce doors against windstorm of claim 11 wherein each said bar bracket comprises two pairs of opposed ears extending away from its bar aperture, one said pair of opposed ears extending a greater distance away from said bar aperture than the other said pair of opposed cars, whereby said bar bracket may be attached to a variety of different door hinges having different clearances.

14. The apparatus to reinforce doors against windstorm of claim 12 further comprising at least one shim fastener whereby at least one said shim may be attached to said bar.

15. A method to reinforce doors against windstorm comprises the steps of:

A. Providing at least one bar bracket having a bar aperture and at least one pair of opposed ears, and an ear bore in each said ear;

B. Removing a hinge pin from a hinge bore in an existing hinge on a door, upon which said bar bracket is to be installed, said door hingeadly depending from said existing hinge;

C. Positioning said bar bracket on said hinge such that said hinge is disposed between said opposed ears, and said ear bores and said hinge bore are co-axial;

D. Inserting a bar bracket fastener through said ear bores and said hinge bore;

E. Repeating steps A-D until all desired bar brackets are installed; and

F. Inserting a bar through at least one said bar aperture.

16. The method to reinforce doors against windstorm of claim 15 comprises the further step of driving at least one shim between said bar and at least one said door and/or an adjacent wall 11.

17. The method to reinforce doors against windstorm of claim 16 comprising the further step of fastening at least one said shim to said bar with a shim fastener.

18. The method to reinforce doors against windstorm of claim 15 comprising the further steps of removing existing hinge fasteners from each said hinge upon which a bar bracket is to be mounted, and replacing each removed hinge fastener with a larger fastener, whereby an attachment between each said hinge and a surface upon which said hinge is mounted may be strengthened.

19. The method to reinforce doors against windstorm of claim 15 comprising the further step of inserting said bar into at least one said bar aperture prior to mounting a bar bracket associated with said bar aperture on a hinge.

20. The method to reinforce doors against windstorm of claim 15 comprising the further steps of removing said bar from each said bar aperture, removing said bracket fastener from each said bracket, removing each said bracket, and re-installing each said hinge pin which was previously removed.

21. A method to reinforce a single door against windstorm comprises the steps of:

A. Providing an apparatus to reinforce doors against windstorm comprising two bar brackets, each said bar bracket comprising a bar aperture, at least one pair of opposed ears, an ear bore in each said ear, and a hinge leaf comprising a hinge leaf wing and a hinge leaf bore;

B. Removing a hinge pin from a hinge bore in an existing hinge on a door upon which said bar bracket is to be installed;

C. Positioning one said bar bracket on said hinge such that said hinge is disposed between said opposed ears, and said ear bores and said hinge bore are co-axial;

D. Inserting a bar bracket fastener through said ear bores and said hinge bore;

E. Attaching said hinge leaf to a door frame opposite the bar bracket installed on said hinge;

F. Positioning another bar bracket on said hinge leaf such that said hinge leaf is disposed between said opposed ears, and said ear bores and said hinge leaf bore are co-axial;

G. Inserting a bar bracket fastener through said ear bores and said hinge leaf bore; and H. Inserting a bar through said bar apertures.

22. The method to reinforce doors against windstorm of claim 21 comprising the further step of driving at least one shim between said bar and said door and/or an adjacent wall.

23. The method to reinforce doors against windstorm of claim 22 comprising the further step of fastening at least one said shim to said bar with a shim fastener.

24. The method to reinforce doors against windstorm of claim 21 comprising the further step of inserting said bar into at least one said bar aperture prior to mounting a bar bracket associated with said bar aperture on said hinge or a hinge leaf.

25. The method to reinforce doors against windstorm of claim 21 comprising the further steps of removing said bar from each said bar aperture, removing said bracket fastener from each said bracket, removing each said bracket, and re-installing each said hinge pin which was previously removed.

* * * * *